US005201867A

United States Patent [19]

Morszeck

[11] Patent Number: 5,201,867

[45] Date of Patent: Apr. 13, 1993

[54] WATERPROOF PHOTOEQUIPMENT BAG

[76] Inventor: Dieter Morszeck, Scheffelstr. 21, D-5000 Koln 41, Fed. Rep. of Germany

[21] Appl. No.: 678,356

[22] PCT Filed: Sep. 19, 1989

[86] PCT No.: PCT/EP89/01088

§ 371 Date: Apr. 24, 1991

§ 102(e) Date: Apr. 24, 1991

[87] PCT Pub. No.: WO90/03128

PCT Pub. Date: Apr. 5, 1990

[30] Foreign Application Priority Data

Sep. 21, 1988 [DE] Fed. Rep. of Germany ..... 3832071

[51] Int. Cl.[5] ..... B65D 33/02; B65D 43/16; B65D 43/22

[52] U.S. Cl. ..... 206/316.2; 220/344

[58] Field of Search ..... 206/316.2, 316.3, 316.1; 220/344; 224/908

[56] References Cited

U.S. PATENT DOCUMENTS

| | | | |
|---|---|---|---|
| 2,478,267 | 8/1949 | Hickler | 206/316.3 |
| 2,803,368 | 8/1957 | Koch | 220/4 |
| 2,836,288 | 5/1958 | Atchison | 220/344 |
| 2,960,137 | 11/1960 | Lipsitz | 206/316.2 |
| 3,910,470 | 10/1975 | Swenson et al. | 206/316.2 |
| 3,923,197 | 12/1975 | Kuhn | 220/344 |
| 4,136,726 | 1/1979 | Lee | 206/316.2 |
| 4,143,695 | 3/1979 | Hoehn | 220/215 |
| 4,190,155 | 2/1980 | Higley | 206/445 |
| 4,465,189 | 8/1984 | Molzan | 220/231 |
| 4,484,682 | 11/1984 | Crow | 206/545 |
| 4,610,286 | 9/1986 | Cyr | 206/316.2 |
| 4,703,519 | 10/1987 | Krenzel | 206/316.1 |

FOREIGN PATENT DOCUMENTS

| | | | |
|---|---|---|---|
| 3627524 | 2/1988 | Fed. Rep. of Germany . | |
| 79166 | 9/1962 | France . | |
| 2045023 | 2/1971 | France . | |
| 2554420 | 5/1985 | France . | |
| 1071588 | 6/1967 | United Kingdom | 206/316.3 |

*Primary Examiner*—Stephen P. Garbe
*Attorney, Agent, or Firm*—Diller, Ramik & Wight

[57] ABSTRACT

A photoequipment bag (1) consists of a universally open container part (3) having a dividable inner space and a closing part (5) unilaterally hinged to the container part (3). The walls of the container part (3) and of the closing part (5) are provided each with a waterproof plastic layer. The plastic layer of the container part (5)is watertightly connected to a first frame portion (2) confining the container aperture, while the plastic layer of the closing part (5) is watertightly connected to the second frame portion (4) locking the closing part (5). The locking means (24) engage the frame portions (2,4) and the latter, in locked condition, are in engagement via a combined labyrinth and contact seal.

16 Claims, 4 Drawing Sheets

WATERPROOF PHOTOEQUIPMENT BAG

BACKGROUND OF THE INVENTION

The invention relates to a photoequipment bag comprising a container part open unilaterally and having a dividable inner space and a closing part hinged unilaterally to the container part and closing the inner space, the walls of the container part and of the closing part including an external flexible material layer and the container part and the closing part being provided with cooperating locking means.

Such photographic bags are required for receiving a camera and its accessory such as interchangeable objectives, filters, flashgun, films, motor winder or video cameras and their accessory so that the individual elements may not meet and that also a certain protection from weather influences is ensured. The inner space of such bags is dividable to form compartments of different dimensions.

There have been known photocases comprising metallic walls which, as a rule, are provided for a more extensive equipment, said cases being also adapted to withstand higher loads, in particular shocks, and they may be water-resistant. However, their relatively high weight is disadvantageous.

On the other hand, light photobags made of fabric, leather or synthetic leather disadvantageously only offer a certain protection against climatic influences, and, if they are soft or semisolid, they are not water-resistant, so that expensive photographic equipments, e.g. for water sports, may be lost for lack of water-resistance and for lack of floatability accordingly. At least, they may be damaged by penetrating water. The known photobag (U.S. Pat. No. 610 286) is neither water-resistant nor does it consist of water-impervious plastic material. It is merely provided with an inner tissue being resistant against humidity but not being water-resistant. The walls are composed of foamed plastic elements which also not close the photobag in a water-resistant manner. Further, the outer textile layer is only water-repellent.

From U.S. Pat. No. 803,368, there is known a thermally insulating container, particularly for the transport of blood plasma, having a multi-layered wall. The outer layer consists of a trough-shaped plastic housing while two internal layers consist of insulating material, e.g. of glass-fiber structures. The inner layer is resistant to humidity.

Thus, said known container consists of two one-pieced shells being connected to each other by separate frame portions. On the one hand, the frame portions are sealed against each other, but, one the other hand, they must be sealed against the outer shells too. Such a container shall only provides good thermal insulation but does not offer absolute safety against penetration of water as required for expensive electronic and photomechanical equipment.

In tropic or subtropic climatic zones with a high air humidity, photographic equipments, in particular their electronic systems, may be affected, if accommodated in conventional photobags.

SUMMARY OF THE INVENTION

It is the object of the invention to provide a photoequipment bag whose inner space is closed such as to be waterproof.

The problem is solved according to the invention in that, in a photoequipment bag made of a unilaterally open container part including a dividable inner space, and a closing part unilaterally hinged to the container part and locking the inner space, the walls of the container part and of the closing part having an external flexible material layer and the container part and the closing part being provided with cooperating locking means, the walls of the container part and of the closing part each have a plastic layer forming a one-pieced and seamless water-impermeable through, the plastic layer of the container part forms a first frame portion defining the container opening, and the plastic layer of the closing portion, by overturning the borders, forms a second frame portion terminating the closing portion, the locking means engage the frame portions, and the frame portions are in engagement in locking condition via a combined labyrinth- and contact seal.

The plastic layer forms a one-pieced and seamless water-impermeable trough having a frame portion defining the container opening, which is effected in that the edge area of the plastic layer is overturned outwardly. In this manner, in connection with a seal ing cooperating with the frame portions, the interior of the photobag can be hermetically sealed. The plastic layer, forming a respective trough, does not need any further elements so that there is also no danger of leakage at the joining areas between the plastic layer and intermediate elements. Then, insulating layers and outer tissue layers can be advantageously arranged between the plastic layer and the frame portion, i.e. the overturned border of the plastic layer, while accessability and functional reliability of the locking members engaging the frame portions are not impaired.

All of the photoequipment bag walls contain a waterproof plastic layer joined watertightly to the respective frame portion at the seam point between container part and closing part. As for the two frame portions, they may be watertightly pressed against each other by a labyrinth and contact seal with the aid of locking means, thus forming an inner space hermetically closed universally and maintaining floatability also of a filled photoequipment bag in cases of need. It is a further advantage of the hermetic sealing that the delicate photographic equipment may be safely housed in zones having a high air humidity, it being still possible to add to the inner space a drying means. It is possible to produce such bags with an extremely light weight and, nevertheless, they offer an optimal protection for high quality optical and electronic instruments.

Preferably, the labyrinth seal consists of a first profile within the range of the first frame portion, and of a second profile complementary to the first, within the range of the second frame portion, while in one of the frame portions, the contact seal is inserted as a flexible inlay in a recess of the labyrinth seal. . . . problems may not arise at the transition points between plastic layer and frame portion.

According to another preferred embodiment, an intermediate layer of foam is provided between the external fabric layer and the plastic layer, the foam layer imparting to the photo-bag some dimensional stability and backing-up the plastic layer without a substantial increase in weight of the photoequipment bag. At the same time, the foam layer is responsible for an excellent insulation of the inner space against coldness or heat.

Preferably, the intermediate layer consists of a hard foam. With the use of hard foam to this effect, a high resistance to shock and to torsion of the photoequipment bag may be achieved.

The frame portion of the closing part may be reinforced by a circumjacent metal profile which ensures a high dimensional stability of the profile at the frame portion of the closing part so that, for instance, in combination with an intermediate hard foam layer, a loadability of the photoequipment bag by a weight of about 100 kg is possible without having to accept too high a weight. Therefore, in case of need, such a photoequipment bag may be also used as a platform for a more favorable position to take photos.

Due to a further configuration of the invention, the locking means consist of at least one lever traction lock which is particularly well suited to press together the two frame portions by a certain pretension.

The inner container wall formed of the plastic layer contains, in a preferred embodiment of the invention, parallel inwardly projecting ribs extending towards the closing part, said ribs contributing to an increase in stability if the photoequipment bag is loaded in their direction. Further, they may serve for dividing the inner space.

BRIEF DESCRIPTION OF THE DRAWINGS

Embodiments of the invention will be explained hereunder in more detail with reference to the drawings in which.

DESCRIPTION OF THE PREFERRED EMBODIMENTS

Figure 1:
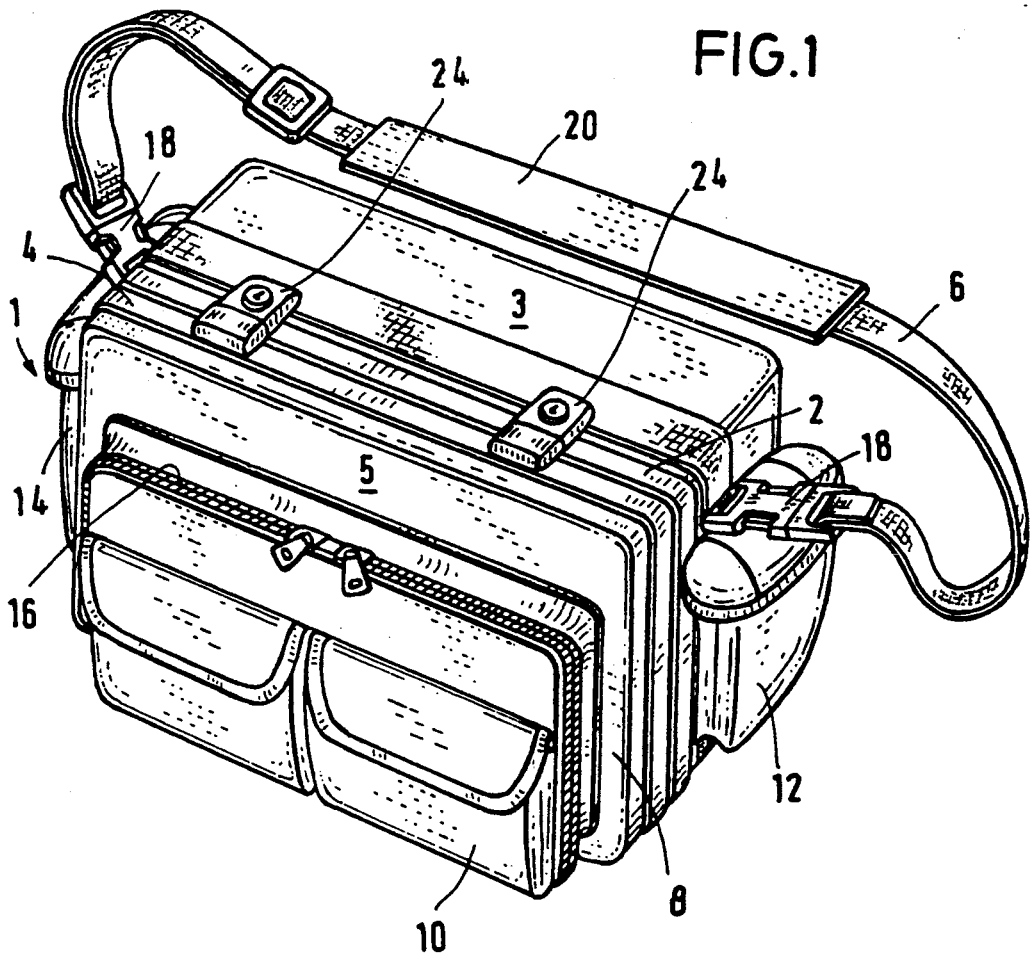
FIG. 1 is a perspective view of a first embodiment.

A first embodiment of the photoequipment bag 1 being substantially square-shaped is provided with a shoulder strap 6 fixed at the respective transverse sides of the bag 1 having a fabric coating 8 preferably made of a nylon tissue. The front side and the transverse sides may be fitted, in the usual manner, with additional pockets 10, 12, 14 which may be closed, for instance by velcro or zip fasteners 16. The shoulder strap 6 is connected to the photoequipment bag 1 by spring-loaded snap fasteners 18 thus allowing to bilaterally set free from the bag the shoulder strap 6 whose length may be changed and which is provided with a shoulder pad 20 for avoiding slipping of the strap 6 from the shoulder, on the one hand, and for improving the weight distribution on the shoulder, on the other hand.

Further, the photoequipment bag 1 comprises a substantially tub-shaped container portion 3 and a closing part 5 in the form of a locking flap or locking lid which each are enclosed by a frame portion 2,4 which, upon closing the photoequipment bag 1, are urged against each other. To this end, as evident from the embodiment of FIG. 1, frame portions 2,4 contain at the bottom of the photoequipment bag 1 a hinge 22 (see FIG. 2) which, at the opposite side, in order words, on top of the photoequipment bag, cooperates with two lever traction locks 24 in order to firmly press together the two frame portions 2,4 over their total peripheral surfaces.

Figure 3:
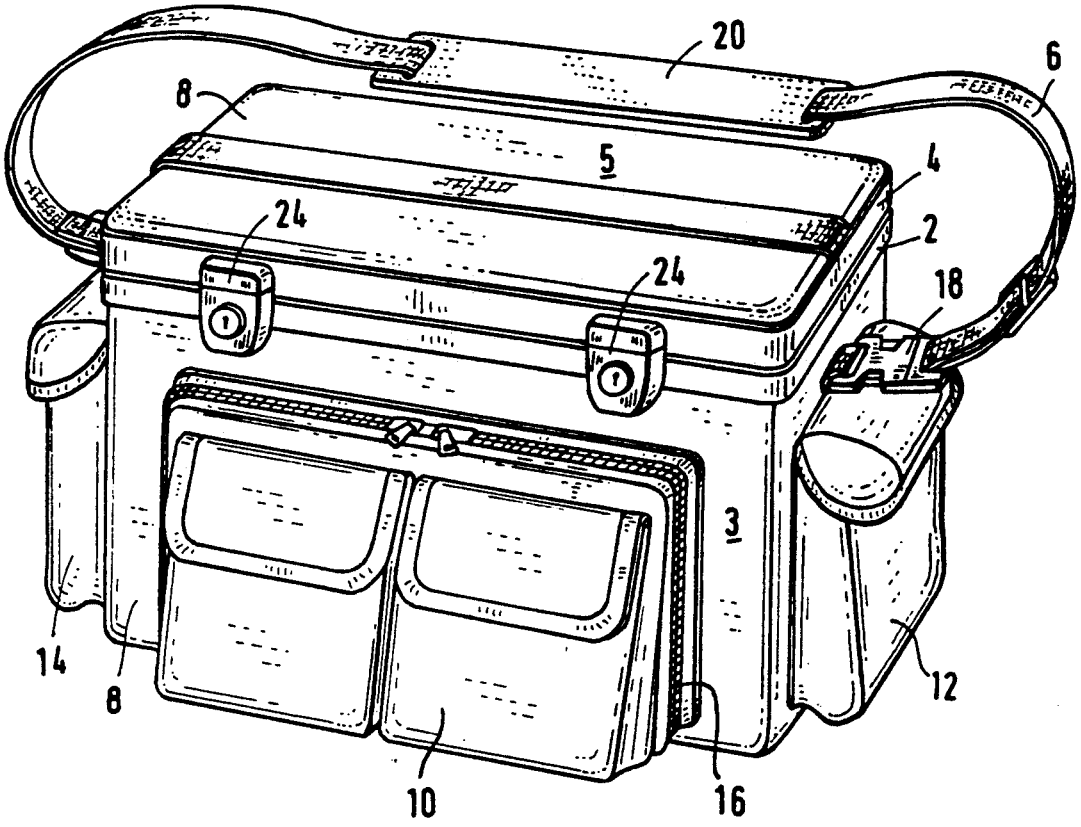
FIG. 3 is a perspective view of a second embodiment.
Figure 4:
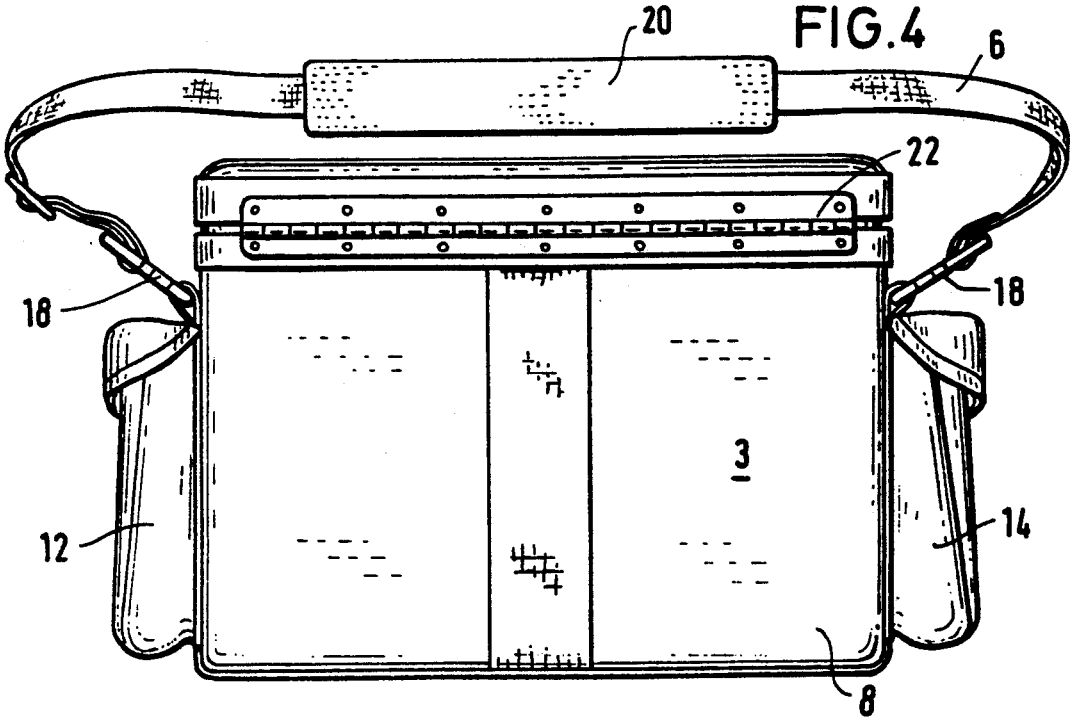
FIG. 4 is a rear view of the second embodiment.

FIG. 3 shows a second embodiment in which the provided closing part 5 is a lid normally taking a horizontal position during transport while the position of the closing part 5 according to the embodiment of FIG. 1 is vertical during transport. In the embodiment of FIG. 4, the upper end of the rear side of the closing part 5 is joined to the container part 3 via a hinge 22. At the front side, there are provided two lockable lever traction locks 24 due to which the second frame portion 4 of the closing part 5 may be urged by pretension against the first frame portion 2 of the container part 3.

The lever traction locks 24 and the hinge 22 are fixed to the frame portions 2,4. If hinges are used, one sole lever traction lock will do.

In place of hinges 22 shown in the two embodiments, it is also possible to provide two spaced, non-illustrated hooking points which allow for a complete removal of the closing part 5 from the container part 3, when the lever traction locks are open. Said hooking points are preferably provided at the points of the frame portions 2,4 confronted with the spaced lever traction locks 24.

Figure 2:
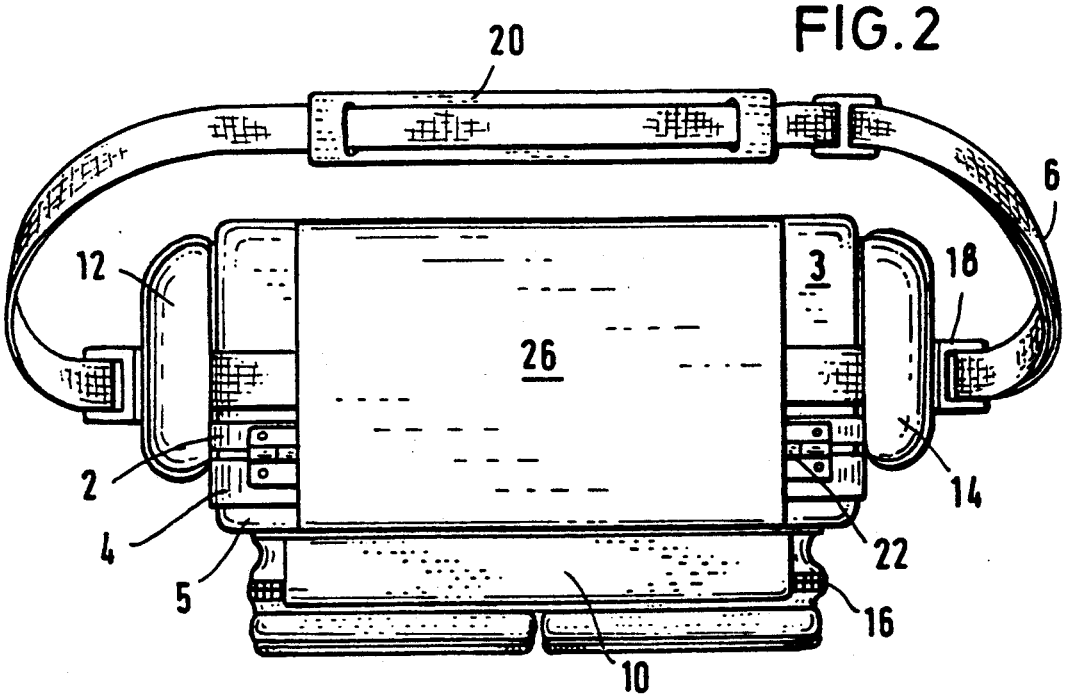
FIG. 2 is a bottom view of the first embodiment.

As obvious from FIG. 2, if the hinge 22 is mounted at the bottom, an addition protective layer 26 is to be provided over the hinge 22 to completely or at least nearly completely coat it over its length in order to exclude penetration of dirt into said hinge 22, if the photoequipment bag 1 is put down. The material of the protective layer 26 may the same as that of the fabric coating 8.

Figure 5:
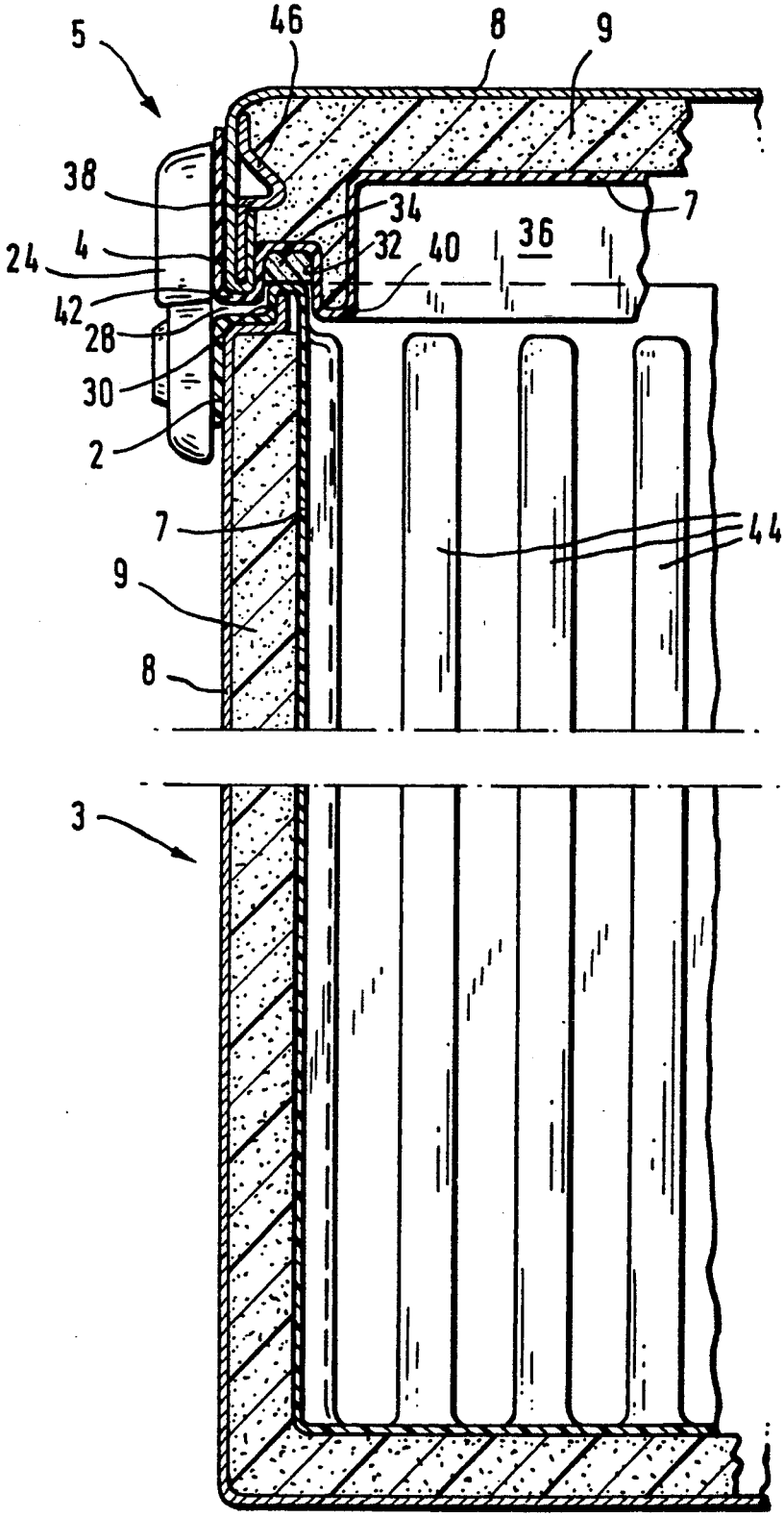
FIG. 5 is a detail cross section of the second embodiment according to FIG. 2.
Figure 6:
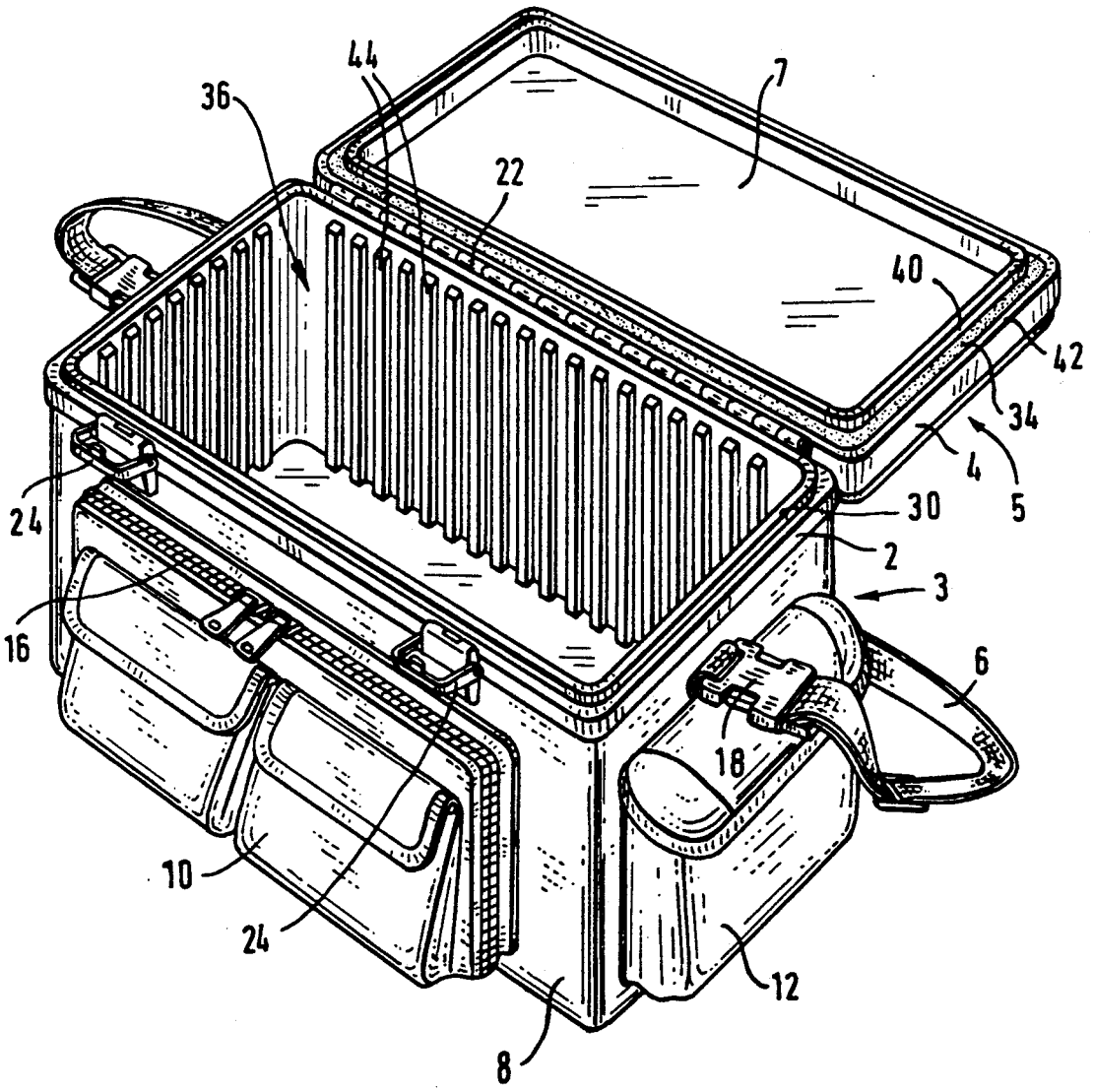
FIG. 6 is a perspective view of the second embodiment with open closing part.

FIG. 5 shows a cross section of an embodiment of FIG. 3. The container part 3 and the closing part 5 are provided with a plastic layer 7 forming the internal layer of the wall composed of three layers in total. Said plastic layer 7 made of a relatively thin-walled thermoplastic material forms a dimensionally stable deep inner tub for the container part 3 or a flat tub-shaped inner surface for the closing part 5. Said tubs being formed for the respective container part 3 and the closing part 5 and being made of one piece are seamless. At the same time, said tubs form the frame portions 2 or 4 by overturning the borders of the plastic layer 7.

On the tub-shaped interior surface formed by the plastic layer 7 of the closing part 5, additional pockets for small accessories may be provided.

Between the fabric coating 8 and the plastic layer 7, there may be arranged additionally a foam layer 9 preferably consisting of a hard foam material.

The cross sections of the frame portions 2,4 are mutually adapted as to their profiles so that, in closed condition, a narrow meander-shaped gap 28 is left between the container part 3 and the closing part 5, said gap, in the form of a labyrinth seal, forming a splash water protection.

The first frame portion 2 is so designed that at the free circumjacent border of the container part 3, the plastic layer 7 overengages the central foam layer 9 and the external fabric coating 8. At the same time, a rib projecting at the first frame portion 2 of the container part 3 towards the closing part 5 engages a complementary profile of the second frame portion 4, viz. a groove 32. The rib 30 and said groove 32 extend at the confronted end faces of the respective frame portions 2,4, and said groove 32 receives a rubber seal 34 which, in addition to the labyrinth seal formed by gap 28, forms a contact seal to permit a hermetic locking of the inner space 36. Preferably, the rubber seal 34 consists of a chloroprene foam strip continuously inserted into said groove 32.

Not only in the frame portion 2 but also in frame portion 4, the foam layer 9 may follow the profiled contour of the plastic layer 7 to contribute to a stiffening of the frame portions 2,4. Further, the second frame portion 4 of the closing part 5 may be reinforced by an aluminum profile 38 in order to ensure a dimensional stability of the lid-type closing part 5. The aluminum profile 38 consists of a strip profile which, seen in cross section, is provided with an inwardly projecting nose 46, such an aluminum profile being light and ensuring a high resistance to deformation, it being possible for profile 46 to find its support in the foam layer 9.

After all, the cross section of the plastic layer 7 of closing part 5 is of a U-shaped profile within the range of the second frame portion 4 at both sides of groove 32 so that two circumjacent ribs 40,42 are formed which receive between them in the groove 32 of a substantially rectangular cross section the rib 30 of the container part 2. In the outer rib 42 of the closing part 5, the aluminum profile 38 is inserted whose lower straight section is enclosed by the fabric coating 8. The plastic layer 7. The fabric coating 8 and the aluminum profile 38 may be mutually bonded or connect for inst. by rivets.

The lever traction locks 24 and the hinge 22 resp. may be suitably fixed to the outsides of the frame portions 2 and 4, e.g. by rivet joints.

The plastic layer 7 as a thermoplastic element may be provided with inwardly projecting mutually parallel longitudinal ribs 44 which extend at right angles to the aperture of the container part 3, said longitudinal ribs 44 contributing to the stability of the plastic layer 7 and additionally allowing to divide the inner space 36 into compartments of different sizes.

A photoequipment bag of such a configuration is light and, nevertheless, waterproof. With a three-layered wall design, it may be highly torsion-resistant and, with a reinforcement of the closing part 5 by an aluminum profile 38, it may withstand a load of up to 100 kg on the closing part 5. By this means, the photoequipment bag may be also used as a pedestal, if required.

What is claimed is:

1. A photoequipment bag comprising a unilaterally open container part defining a dividable inner space, a closing part, hinge means for hinging said closing part to said container part for effecting opening and closing of said inner space, locking means for locking said container part and said closing part when said inner space is closed, said container part and closing part being each defined by a plastic material layer defining bounding opposing peripheral edge frame portions of said container part and said closing part, said frame portions being in contiguous relationship when said inner space is closed, said locking means being carried by said frame portions, means defined by the plastic material layer of said frame portions for forming a tongue and groove seal, and a metal profile reinforcing said closing part frame portion.

2. The photo equipment bag as defined in claim 1 wherein said tongue and groove seal is defined by a tongue of one of said frame portions substantially seated within a complementary groove of the other of said fame portions.

3. The photo equipment bag as defined in claim 1 wherein said tongue and groove seal is defined by a tongue of one of said frame portions substantially seated within a complementary groove of the other of said fame portions, and a gap between said tongue and groove.

4. The photo equipment bag as defined in claim 1 wherein said tongue and groove seal is defined by a tongue of one of said frame portions substantially seated within a complementary groove of the other of said fame portions, and a gap between said tongue and groove housing a sealing member.

5. The photoequipment bag as defined in claim 1 wherein said plastic material layer is thermoplastic material thermo-formed to form the tongue and groove seal of said frame portions.

6. The photoequipment bag as defined in claim 1 including an intermediate foam layer inboard of each of said plastic material layers, and an outer fabric layer of each of said container part and said closing part.

7. The photoequipment bag as defined in claim 1 including an intermediate hard foam layer inboard of each of said plastic material layers, and an outer fabric layer of each of said container part and said closing part.

8. The photoequipment bag as defined in claim 1 wherein said locking means includes at least one lever traction lock.

9. The photoequipment bag as defined in claim 1 wherein said container part has a mouth defined by said container part frame portion, and said plastic material layer includes a plurality of parallel ribs within said inner space extending toward said mouth.

10. A container comprising a container body and a closure, each of said container body and closure being defined by an outer fabric material layer, an intermediate layer and an inner thermo-formed plastic layer, said container body and closure have peripheral frame portions in contiguous relationship in a closed position of said closure relative to said container body, said peripheral frame portions each being defined in part by portions of said inner thermo-formed plastic layer disposed in generally spanning relationship each to a respective one of said intermediate layers, and said inner thermo-formed plastic layer portions defining cooperative tongue and groove means for interlocking said closure and container body in the closed position of said closure relative to said container body.

11. The container as defined in claim 10 wherein said tongue and groove means are defined by a tongue of said container body and a groove of said closure.

12. The container as defined in claim 11 including a metallic strip reinforcing said closure groove.

13. The container as defined in claim 12 wherein said inner thermo-formed plastic layer portions terminate in respective terminal portions one in exterior overlapping relationship to a respective one of each of said outer fabric material layers.

14. The container as defined in claim 12 wherein said metallic strip is disposed between said outer fabric material layer and said intermediate layer.

15. The container as defined in claim 14 wherein said inner thermo-formed plastic layer portions terminate in respective terminal portions one in exterior overlapping relationship to a respective one of each of said outer fabric material layers.

16. The container as defined in claim 10 wherein said inner thermo-formed plastic layer portions terminate in respective terminal portions one in exterior overlapping relationship to a respective one of each of said outer fabric material layers.

* * * * *